United States Patent [19]

Ostroff

[11] 4,044,683

[45] Aug. 30, 1977

[54] HEAT GENERATOR

[75] Inventor: Harold H. Ostroff, Normandy, Mo.

[73] Assignee: McDonnell Douglas Corporation, St. Louis, Mo.

[21] Appl. No.: 835,815

[22] Filed: Aug. 20, 1959

[51] Int. Cl.[2] ..... F42B 4/26

[52] U.S. Cl. ..... 102/90; 102/37.8; 431/352; 102/39; 102/66

[58] Field of Search ..... 158/86, 89, 112, 113; 102/39, 6, 65, 66, 90, 37.8; 60/39.65, 39.72; 110/97

[56] References Cited

U.S. PATENT DOCUMENTS

| | | | |
|---|---|---|---|
| 2,336,816 | 12/1943 | Thompson | 158/112 |
| 2,546,731 | 3/1951 | Duff | 158/86 |
| 2,595,999 | 5/1952 | Way et al. | 158/86 |
| 2,855,030 | 10/1958 | Richards | 158/89 |
| 2,870,604 | 1/1959 | Conrad | 60/39.72 |
| 2,944,399 | 7/1960 | McCardle et al. | 60/39.72 |
| 2,964,907 | 12/1960 | Toone | 60/39.72 |
| 2,974,485 | 3/1961 | Schiefer | 60/39.65 |

*Primary Examiner*—Verlin R. Pendegrass
*Attorney, Agent, or Firm*—Gravely, Lieder & Woodruff

[57] EXEMPLARY CLAIM

1. A decoy missile for high speed air travel comprising the improvement of a casing open at one end, a substantially closed air receiving chamber in said casing, conduit means supplying combustion air under pressure from a remote source connected to said closed chamber, hollow flameholder means mounted in said closed chamber to admit air under pressure to the hollow interior, said flameholder means having an open end adjacent said one end of the casing, fuel supply spray means connected to said flameholder means to supply fuel thereto under pressure, igniter means to initiate combustion of the fuel sprayed into the air within the hollow interior of said flameholder means, and a heat radiating foraminous member carried by said casing over the open ends of said casing and flameholder means and exposed for viewing in the high speed air stream, said foraminous member forming with the hollow interior of said flameholder means an enclosed combustion space and being composed of a finely perforated sintered porous material through which the hot combustion gases pass and which imposes a substantial pressure drop between the combustion space and the exterior surface of said member to create a layer of hot gases on the exterior surfaces which is relatively stable in the high velocity air flow about said casing and over the exterior of said member, the products of combustion passing through said foraminous member acting to soak said member and raise the temperature thereof to infrared emission temperature.

2 Claims, 2 Drawing Figures

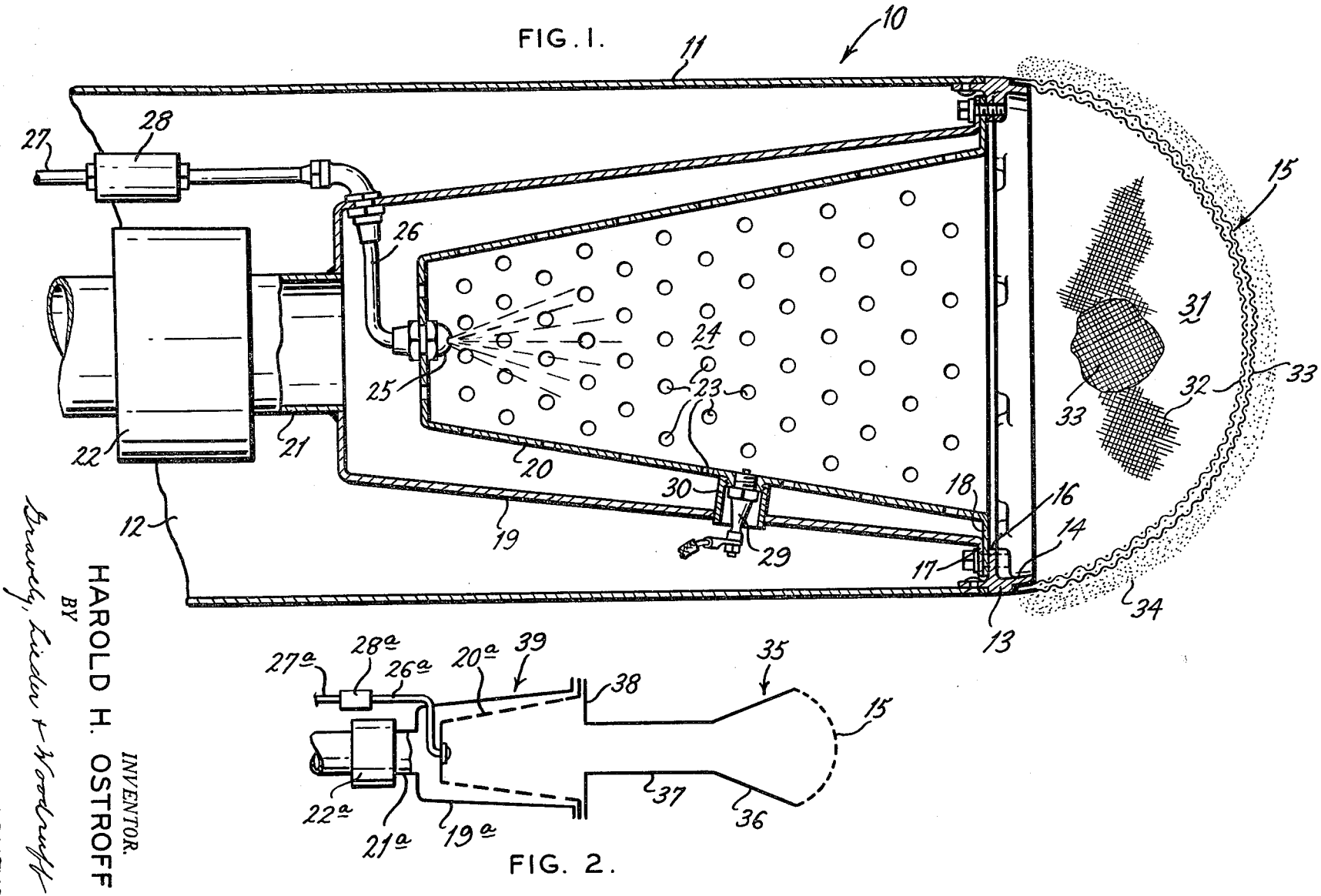
INVENTOR.
HAROLD H. OSTROFF
BY
Gravely, Lieder + Woodruff
ATTORNEYS

HEAT GENERATOR

This invention relates to heat generators in which a large exposed heat radiating area is supplied with heat under conditions of small mass flow and pressure drop.

An object of the invention is to provide an efficient heat generator having a large exposed heat radiating area so that the generator may be used on decoy missiles and the like as protection against armed heat seeking missles, projectiles, and similar bodies.

Another object of the invention is to provide compact apparatus having an efficient fuel combustor associated with a heat generator designed to absorb heat and retain a substantially uniform temperature.

Another object of the invention is to provide a heat generator with an improved heat radiating surface of foraminous character so that a heat retaining boundary layer may be established to counteract the rapid dissipation of heat encountered with high speed air flow past the radiating surface.

Still another object of the invention is to provide a heat generating device which is compact and highly efficient as a source of a large amount of heat for use in decoy missiles as protection for aircraft which are subject to attack by heat seeking missiles.

Other objects and advantages of the invention reside in the means, elements, components and combinations of parts hereinafter described or pointed out in connection with the following description of preferred embodiments disclosed in the accompanying drawing, wherein:

FIG. 1 is a longitudinal sectional elevational view of a heat generator embodying the features which constitute the subject of this invention; and FIG. 2 is a schematic diagram of a modified heat generator device according to this invention.

In the drawing the heat generator device consists essentially in a fuel combustor in which air and fuel are burned to produce a large volume of heat, and in a radiator means having a foraminous surface of large area and capable of attaining a uniform temperature throughout by allowing the hot gases of combustion to pass through the surface and establish an external boundary layer as protection against rapid heat dissipation by the scrubbing action of the high velocity external air flow.

In FIG. 1 the heat generator device 10 is shown as comprising a housing 11 of any convenient cross-sectional configuration having an open end 12 to receive the parts of the combustor later to be described. The opposite end of the housing 11 is provided with a rim 13 which supports at its exterior flange 14 a heat radiating foraminous member 15, and also supports on its interior flange 16 the adjacent flanges 17 and 18 of an air chamber 19 and flameholder basket 20 respectively. The air chamber 19 is connected with an air supply conduit 21 in which a flow control valve is disposed. The valve is represented generally by its housing 22 and may be of any convenient type, hence no specific valve has been shown. The flameholder basket 20 contained within the air chamber 19 is formed with a plurality of air orifices or openings 23 which admit combustion air to the combustion space 24. A fuel nozzle 25 carried in the wall of the basket 20 is supplied with fuel from a suitable conduit 26 leading thereto from a fuel supply conduit 27 controlled by a shut-off valve 28. Combustion of the fuel and air in space 24 is initiated by a suitable igniter spark plug 29 carried in the wall of the basket 20 and protected by a sleeve 30 which extends through the wall of the air chamber 19, as shown.

In the device shown in FIG. 1, the air supplied at conduit 21 is under a positive pressure and flows through the orifices 23 into the basket 20 where it mingles with the fuel and burns. The orifices act to retain the flame in the combustion space 24 and results in efficient combustion to produce a large volume of hot gases which move outwardly of the space 24 past the rim 13 and into the radiator space 31. The perforated flameholder basket, therefore, controls the through-put of air so that the velocity is well below the flame propagation rate.

The heat radiating member 15 of FIG. 1 comprisesa porous or foraminated wall composed of layers 32 and 33 of metallic screen material which has been sintered or suitably treated to make it sufficiently rigid for the purpose in view, but which still retains a porous character so that the burning gases may soak through the same and establish a hot boundary layer of gases depicted at 34. The member 15 may consist also of in a sheet material having a very fine perforation network which will yield the same or equivalent effect of the preferred sintered layers of fine mesh screen material.

A practical application for the heat generator device 10 is in decoy missiles which are released to attract armed heat seeking missiles and thereby protect aircraft while on combat missions. The principal concern in this application is the production of adequate heat in a large radiator area, such as in the heat generator member 15, with a relatively small mass flow of burning fuel and under a low pressure drop. The porous member 15 has been found to produce very good heat transfer from the gases and to provide a uniform radiator temperature with the creation of the external boundary layer 34 of hot gases. The layer 34 reduces the heat loss which would otherwise result from the scrubbing action of the external air flow while the decoy missile is in flight.

Constant radiator temperature at member 15 may be obtained with a constant fuel flow by setting the air valve 22 to maintain a constant pressure drop across the combustor represented by the basket 20. Furthermore, combustion is enhanced by back radiation from the foraminous wall to the mass of air-fuel mixture approaching the wall, whereby the combustion reaction is completed.

The device of FIG. 1 illustrates a compact device and is to be preferred. However, it is possible that certain applications may require a separate disposition of the components and FIG. 2 illustrates such a possibility. In FIG. 2, the heat radiator 35 is composed of a casing 36 carrying the porous member 15 as in FIG. 1, and a conduit 37 connected by suitable means 38 to the outlet end of the combustor 39. The combustor 39 consists of the air chamber **19*a*, the flameholder basket 20*a*, the air supply conduit 21*a* with control valve 22*a* therein. Fuel for nozzle 25*a* is supplied by conduit 27*a*, shut-off valve 28*a* and conduit 26*a***.

While one application or use of this invention has been explained, it is possible that other uses of a commerical nature may be made thereof. For example, the heat radiating wall is an effective infrared radiator which suggests its use in connection with paint drying. The large heat radiating area also may be useful as a space heater. Other uses will come to mind.

It should now be appreciated how the present heat generator operates and in that manner it may be constructed for the purpose in view, and it is understood that changes and variations may be made without departing from the spirit and scope of the invention as it may be defined in the appended claims.

What is claimed is:

1. A decoy missile for high speed air travel comprising the improvement of a casing open at one end, a substantially closed air receiving chamber in said casing, conduit means supplying combustion air under pressure from a remote source connected to said closed chamber, hollow flameholder means mounted in said closed chamber to admit air under pressure to the hollow interior, said flameholder means having an open end adjacent said one end of the casing, fuel supply spray means connected to said flameholder means to supply fuel thereto under pressure, igniter means to initiate combustion of the fuel sprayed into the air within the hollow interior of said flameholer means, and a heat radiating foraminous member carried by said casing over the open ends of said casing and flameholder means and exposed for viewing in the high speed air stream, said foraminous member forming with the hollow interior of said flame- holer means an enclosed combustion space and being composed of a finely perforated sintered porour material through which the hot combustion gases pass and which imposes a substantial pressure drop between the combustion space and the exterior surface of said member to create a layer of hot gases on the exterior surfaces which is relatively stable in the high velocity air flow about said casing and over the exterior of said member, the products of combustion passing through said foraminous member acting to soak said member and raise the temperature thereof to infrared to emission temperature.

2. A decoy missile for high speed air travel comprising a casing having an open end, an imperforate wall air receiving chamber in said casing, conduit means connected to said chamber to supply combustion air under pressure thereto, a perforated flameholder basket in said chamber spaced from the walls thereof, the air passing into said basket through said perforations, said basket having an outlet facing said casing opening, fuel spray means connected to said basket spaced from said basket outlet, means to supply fuel to said spray means under pressure, means to ignite the fuel and air within said basket, and an infrared radiating foraminous member mounted over the open end of said casing and forming with said basket a combustion space, said foraminous member being exposed for viewing in the high speed air stream and composed of porous sintered material having a semispherical shape and imposing a substantial pressure drop on the hot gas flow from the interior combustion space to cause high velocity flow of hot gases of combustion therethrough to the exposed exterior surface, said foraminous member retaining the hot gases on the exterior surface to establish a hot gas boundary layer which is substantially stable under the high speed ambient air flow, whereby said foraminous member has its inner and outer surfaces substantially soaked in the hot gases to elevate the temperature to infrared emission temperature.

* * * * *